US010227148B2

(12) United States Patent
Brüker et al.

(10) Patent No.: US 10,227,148 B2
(45) Date of Patent: Mar. 12, 2019

(54) METHOD FOR PACKAGING GROUPS OF ARTICLES COMBINED TO FORM PACKAGING UNITS

(75) Inventors: Alexander Brüker, Kalkar (DE); Bernd Cox, Weeze (DE); Josef Duepper, Bedburg-Hau (DE); Michael Joerissen, Bedburg-Hau (DE); Thomas Lelie, Kleve (DE)

(73) Assignee: KHS GmbH, Dortmund (DE)

( * ) Notice: Subject to any disclaimer, the term of this patent is extended or adjusted under 35 U.S.C. 154(b) by 668 days.

(21) Appl. No.: 14/115,457

(22) PCT Filed: Nov. 8, 2011

(86) PCT No.: PCT/EP2011/005597
§ 371 (c)(1),
(2), (4) Date: Nov. 4, 2013

(87) PCT Pub. No.: WO2012/149947
PCT Pub. Date: Nov. 8, 2012

(65) Prior Publication Data

US 2014/0075890 A1 Mar. 20, 2014

(30) Foreign Application Priority Data

May 3, 2011 (DE) ..... 10 2011 100 367
Oct. 28, 2011 (DE) ..... 10 2011 117 165

(51) Int. Cl.
*B65B 11/16* (2006.01)
*B65B 11/12* (2006.01)

(52) U.S. Cl.
CPC ..... *B65B 11/16* (2013.01); *B65B 11/12* (2013.01)

(58) Field of Classification Search
CPC ..... B65B 11/12; B65B 11/004; B65B 11/16; B65B 11/48; B65B 27/04; B65B 49/00; B65D 75/26
USPC ..... 53/461, 465, 48.8, 210, 226, 233, 412
See application file for complete search history.

(56) References Cited

U.S. PATENT DOCUMENTS 1,787,116 A * 12/1930 Marasso ..... B65B 49/12 53/371.4
2,253,211 A * 8/1941 Rapp ..... B65B 11/12 53/232
2,620,964 A * 12/1952 Rose ..... B65B 11/42 229/87.01

(Continued)

FOREIGN PATENT DOCUMENTS

DE 15 86 015 A1 5/1970
DE 42 07 725 A1 9/1993

(Continued)

*Primary Examiner* — Gloria R Weeks
*Assistant Examiner* — Dariush Seif
(74) *Attorney, Agent, or Firm* — Occhiuti & Rohlicek LLP

(57) ABSTRACT

A method of combining groups of articles to form packaging units includes wrapping a packaging unit along a running direction thereof on a transporting path with a sheet material, concurrently with the wrapping, forming a sheet-material overlap and folding flaps that each project beyond the packaging unit along transverse peripheries thereof, positioning the folding flaps against the packaging unit as the packaging unit passes through a folding unit, and fixing the folding flaps to each other, thereby forming a sheet-material wrapper that is closed on all sides.

9 Claims, 5 Drawing Sheets

(56) References Cited

U.S. PATENT DOCUMENTS 2,722,094 A * 11/1955 Forster ..... B65B 11/16 53/224
2,981,043 A * 4/1961 Arvidson ..... B65B 11/12 53/206
3,110,144 A * 11/1963 Johansen et al. ..... B65B 11/22 53/224
3,461,645 A * 8/1969 Snyder ..... B29C 65/18 53/373.4
3,507,089 A * 4/1970 Mizzelle ..... B65B 11/12 53/131.1
3,507,091 A * 4/1970 Gillespie ..... B65B 11/12 53/131.2
3,681,893 A * 8/1972 De Barge ..... B65B 49/14 53/209
3,698,152 A * 10/1972 Reed ..... B65D 75/08 206/451
3,739,547 A * 6/1973 Brevko ..... B65B 9/026 53/230
3,808,767 A * 5/1974 Reid ..... B65B 53/063 53/370.9
3,855,758 A * 12/1974 Walter ..... B65B 49/16 53/226
RE28,535 E * 9/1975 Ganz ..... B65B 11/10 53/210
3,986,319 A * 10/1976 Puskarz ..... B65B 11/004 53/207
4,073,123 A * 2/1978 Schoppee ..... B65B 11/12 53/234
4,109,444 A * 8/1978 Lee ..... B65B 43/285 493/181
4,250,693 A * 2/1981 Andersson ..... B65B 5/024 53/207
4,460,349 A * 7/1984 Charron ..... B31B 1/54 493/131
4,519,181 A * 5/1985 Sherman ..... B65B 7/20 493/151
4,571,916 A * 2/1986 Meuwly ..... B65B 35/40 198/419.3
4,624,096 A * 11/1986 Nordstrom ..... B65B 11/12 53/209
4,689,934 A * 9/1987 Ganz ..... B65B 21/245 53/233
4,736,569 A * 4/1988 Hudson ..... B65B 7/20 53/377.2
5,046,258 A * 9/1991 Cahill ..... B65B 11/12 53/206
5,065,856 A * 11/1991 Reid ..... B65B 11/10 198/419.3
5,197,260 A * 3/1993 Chevalier ..... B65B 11/004 53/209
5,228,273 A * 7/1993 Kovacs ..... B65B 49/10 493/157
5,305,580 A * 4/1994 Draghetti ..... B65B 11/30 53/399
5,417,032 A * 5/1995 Calvert ..... B65B 7/20 493/156
5,437,144 A * 8/1995 Akiyama ..... B65B 25/14 53/230
5,570,563 A * 11/1996 Focke ..... B65B 49/14 53/370.6
5,619,843 A * 4/1997 Ganz ..... B65B 11/10 53/543
5,765,336 A * 6/1998 Neagle ..... B65B 5/026 53/201
5,806,289 A * 9/1998 Sassi ..... B65B 19/24 493/163
5,839,253 A * 11/1998 Draghetti ..... B65B 19/221 53/234
5,996,318 A * 12/1999 Draghetti ..... B65B 11/40 53/234
6,408,600 B1 * 6/2002 Nankervis ..... B29C 65/224 53/477
6,643,996 B2 * 11/2003 Spatafora ..... B65B 19/225 53/228
6,766,625 B2 * 7/2004 Cinotti ..... B65B 25/14 53/230
6,901,724 B2 * 6/2005 Tale' ..... B65B 19/223 53/234
7,200,978 B1 * 4/2007 Focke ..... B65B 19/20 493/156
7,503,157 B2 * 3/2009 Ford ..... B65B 5/068 53/233
7,707,805 B2 * 5/2010 Gorrieri ..... B65B 11/12 53/209
2002/0083681 A1 * 7/2002 Fahs ..... B65D 75/66 53/412
2002/0116895 A1 * 8/2002 Antoniazzi ..... B65B 11/22 53/230
2005/0193686 A1 * 9/2005 Chao ..... B65B 11/10 53/210
2005/0229538 A1 * 10/2005 Dall' Omo ..... B65B 11/22 53/134.1
2008/0120948 A1 * 5/2008 Martin ..... B65B 7/20 53/491
2009/0071102 A1 * 3/2009 Cerf ..... B65B 21/245 53/410
2011/0061339 A1 * 3/2011 Hartness ..... B29C 65/106 53/203
2011/0139664 A1 * 6/2011 Ageling ..... B65B 11/12 206/497
2015/0183539 A1 * 7/2015 Cox ..... B65B 49/08 53/456

FOREIGN PATENT DOCUMENTS

DE 20 2006 020 359 U1 7/2008
DE 10 2008 052633 A1 4/2010
DE 20 2010 013 513 U1 12/2010
EP 0 479 498 A1 4/1992
GB 961129 A * 6/1964 ..... B65B 11/12
GB 1055146 A * 1/1967 ..... B65B 7/08
WO 2005/080206 A1 9/2005
WO 2008/096386 8/2008
WO WO 2010046037 A2 * 4/2010 ..... B65B 11/12

* cited by examiner

METHOD FOR PACKAGING GROUPS OF ARTICLES COMBINED TO FORM PACKAGING UNITS

RELATED APPLICATION

This application is the national stage entry under 35 USC 371 of PCT/EP2011/005597, filed on Nov. 8, 2011 which, under 35 USC 119, claims the benefit of the priority date of German application DE 10 2011 100 367.7, filed on May 3, 2011, and German application DE 10 2011 117 165.0, filed Oct. 28, 2011 the contents of which are herein incorporated by reference.

FIELD OF INVENTION

The invention relates to a method and an apparatus for packaging groups of articles combined to form packaging units.

BACKGROUND

Bottles, in particular plastic bottles, cans etc., are often combined to form groups and wrapped with a sheet material in practice and in the daily production sequence. If the sheet material is a plastic sheet material, the sheet material is also shrunk so that the articles form a stable packaging unit and undergo reciprocal fixing with the help of the shrunk sheet material. In this process, open, lateral, so-called shrinkage holes are typically observed.

In the case of a method and associated apparatus of the embodiment described above according to DE 42 07 725 A1, a procedure for this purpose is adopted such that a sheet material carrier bar moves beneath a sheet-material coil. The sheet material carrier bar follows a circular path over the group of articles or the product group, and as it does so, wraps the already mentioned sheet-material coil over this product group. The sheet material carrier bar, together with the trailing end of the sheet material, subsequently descends into a slit of a transporting path. During the onward transport of the product group, which is wrapped in this way, it travels over the slit. As it does so, it also pulls the leading end of the sheet-material coil beneath itself. Consequently, the product group stands on the overlapping ends of the sheet-material coil, the sheet-material overlap. The ends of the sheet material coil or the sheet-material overlap are welded during the subsequent shrinking process.

The described process has generally proven successful but is in need of some improvement insofar as the stability of the produced packaging unit is concerned. It is a fact that the regularly provided side shrinkage holes that are open at both ends result in movement or possible movement, relative to each other, of the articles that are combined to form the packaging unit. This leads to instabilities of the packaging unit, especially if the individual articles are in themselves heavy and/or can be easily displaced against one another. This is typically the case with cans.

The prior art also describes a packaging machine that, according to DE 20 2010 013 513 U1, is to be equipped with a reliably functioning guide facility for strip and sheet material. Associated packaging paths are guided over flat guiding elements for this purpose. At least one of the guiding elements is configured as an ultrasound storage unit. The problems described above in the subsequent use of the packaging unit are not significantly influenced as a result of this.

Comparable comments apply to the machine for the packaging of articles as described in DE 20 2006 020 359 U1. Here, a take-off roll for feeding the sheet material is equipped with at least one textured surface in order to increase the overall functional reliability.

SUMMARY

The invention is based on the technical problem of further developing a like method and an apparatus for packaging groups of articles combined to form packaging units such that, in particular, the stability of the packaging unit produced in such a way is significantly improved compared with existing methods.

The invention resolves this technical problem by a method for packaging groups of articles combined to form packaging units, the method comprising the following steps:

- Wrapping the respective packaging unit in its running direction on a transporting path with a sheet material, there being simultaneously formed a sheet-material overlap and folding flaps that each project beyond the packaging unit along the transverse peripheries;
- Positioning the folding flaps against the packaging unit as they pass through a folding unit, as well as subsequent and/or simultaneous mutual fixing of the folding flaps to form a sheet-material wrapper that is closed on all sides.

For the purpose of the invention, the term "sheet material" means a very thin sheet, usually of rectangular shape, made from a material with which the packaging unit is to be wrapped. While the sheet material is usually a plastic sheet material, a metal or aluminium sheet material or even a paper sheet material are also conceivably encompassed by the invention. The sheet material is usually stored on a sheet-material roll and cut to length with a cutting apparatus. The length of the sheet-material section or of the sheet-material sheet that is thus produced is selected such that the packaging unit that is to be wrapped can be fully enclosed in its running direction, including the sheet-material overlap.

The sheet-material overlap describes an overlap region between a sheet-material beginning and a sheet-material end. The sheet-material overlap, or sheet-material overhang, can, when the sheet material lies against the packaging unit, be within the range of several millimeters, for example between 10 mm and 50 mm, and preferably between 20 mm and 40 mm.

Within the scope of the invention, typically the individual groups of articles are automatically and continuously packaged as they are conveyed along on the transporting path. For this purpose the individual packaging units are wrapped with the previously cut-to-length sheet-material section including the sheet-material overlap, and, as the packaging unit continues to be conveyed along the transporting path in the running direction, the folding flaps that project beyond the packaging unit along the transverse peripheries are then, as it were, automatically positioned against the packaging unit. The result is a totally closed sheet-material wrapper that, in particular, avoids open lateral shrinkage holes and instead seals the side regions of the packaging unit through the folding flaps positioned against it.

Because the folding flaps are not only positioned against the packaging unit but also simultaneously or subsequently undergo a fixing as they pass through the folding unit, the sheet-material wrapper that is formed and closed in this way offers the necessary stability, such that, for example, subsequent movements of the articles relative to one another are either completely suppressed or are, at most, reduced to a harmless extent. Moreover the folding operation is performed continuously or synchronously with the transport of the packaging unit in the running direction on the transporting path so that ultimately no delays are observed or can occur during the production of the desired packaging units.

A shrinking process may follow the described packaging operation. Under certain circumstances this results in the stability of the sheet-material wrapper and hence of the sheet-material-wrapped packaging unit being even further increased if required. The shrinking process is, of course, not absolutely necessary.

According to an advantageous embodiment, two folding flaps lying opposite one another and forming associated folding-flap pairs are realized in each lateral region of the packaging unit wrapped with the aid of the sheet material. This means that the usually four folding flaps formed in the lateral region of the packaging unit form two associated folding-flap pairs from the two folding flaps each lying opposite one another. A first folding-flap pair and a second folding-flap pair may in fact be distinguished from one another. As a rule the two folding-flap pairs are positioned against the packaging unit sequentially.

This is usually effected by the folding flaps of one first folding-flap pair and the folding flaps of the other folding-flap pair being positioned against the packaging unit by a predominantly horizontal and by a predominantly vertical folding operation respectively. The horizontal folding operation is associated with a folding movement in a predominantly horizontal plane. The vertical folding operation on the other hand corresponds to a folding movement in a predominantly vertical plane.

The folding operation itself is usually effected so that first the leading folding flap of the first folding-flap pair and then the upper folding flap of the second folding-flap pair is positioned against the packaging unit. In principle this sequence can also be reversed, in which case the upper folding flap of the second folding-flap pair is positioned against the packaging unit first, and only then the leading folding flap of the first folding-flap pair. This happens as the wrapped packaging unit is entering the folding unit. The trailing folding flap of the first folding-flap pair is then normally positioned against the packaging unit. Finally, the folding operation encompasses the lower folding flap of the second folding-flap pair.

Compared with the lateral region of the wrapped packaging unit therefore, the second folding-flap pair, whose two folding flaps can be positioned against the packaging unit by a predominantly vertical folding operation, has an upper folding flap and a lower folding flap. Within the scope of the invention, a procedure is adopted whereby, of these two folding flaps of the second folding-flap pair, first the upper folding flap is positioned against the packaging unit and only on completion of the operation is the lower folding flap then positioned against the packaging unit. The reverse procedure can of course also be adopted.

The individual folding operations can also overlap one another in time. The folding operations can moreover be equipped with different folding times. This means that the folding operation for the leading folding flap of the first folding-flap pair may be started before the folding operation of the upper (or lower) folding flap of the second folding-flap pair. However because the folding time for the upper (lower) folding flap is typically designed to be shorter than that for the leading folding flap, the folding operation for the upper (lower) folding flap is already ended when the leading folding flap of the first folding-flap pair is fully positioned against the lateral region of the packaging unit.

The folding operation is effected with the aid of a plurality of folding elements within the folding unit. To this end, the folding flaps are folded by way of at least one stationary folding element and/or a folding element that is moved with the packaging unit. The design is usually configured such that the folding element moved with the packaging unit is moved predominantly synchronously together with the packaging unit. The synchronous movement does not necessarily imply a comparable speed of the moved folding element relative to the packaging unit on the transporting path in running direction. Rather, the speed of the moved folding element must be matched to the speed of the packaging unit on the transporting path in running direction.

The procedure usually adopted here is that, during the folding operation, the folding flaps that are folded first and last are each positioned against the packaging unit by way of a stationary folding element. During interposed folding steps in the course of the folding operation on the other hand, predominantly the one or the plurality of associated folding flaps are positioned against the packaging unit by way of the one or the plurality of moved folding elements(s).

Not only can the folding flap be folded and positioned against the packaging unit by way of the folding element, but the folding element and/or one or a plurality of downstream pressing elements usually also ensure that the folding flaps are mutually fixed. This can happen in any conceivable manner, for example in such a way that the respective folding element is heated up and consequently the folding flaps thereby affected undergo an intentional connecting or fixing with one another through, if necessary, a local welding.

The folding element(s) can be heated by a variety of conceivable methods. The folding elements can, for example, be brought up to the temperature required for local welding through externally applied energy, for example hot air, infrared radiation, etc. It is also within the scope of the invention for the respective folding element to be equipped with an internal heating unit, for example tubes for hot air, a heating wire etc. The scope of the invention of course also encompasses measures of such type whereby the places to be fixed, independently of the folding elements, are heated from the exterior, for example with a laser beam, an infrared radiation source, an ultrasonic source, etc. This means that while the folding elements and/or the additional pressing elements ensure that the folding flaps adopt the desired mutual position, the previously mentioned additional energy source ensures that the required and mostly thermal energy is provided from the exterior so that the folding flaps fuse locally and as a result undergo the desired mutual fixing.

A further method of fixing consists in electrostatically charging the individual folding flaps. To this end, the folding flaps, or the complete packaging unit equipped with the sheet-material wrapper can, can be conveyed past appropriate electrodes. Because the sheet material is typically a plastic sheet material made, for example, from polyethylene terephthalate (PET), polyethylene (PP), polypropylene (PP) or a similar material, electrostatic charges are readily generated in the region of the folding flaps with the aid of an electrostatic field. These electrostatic charges ensure that the folding flaps at least temporarily undergo the desired fixing. In such a case, when the wrapped packaging unit is subsequently transferred into a shrinking tunnel or to a shrinking unit in general, the temporary fixing ensures that, subsequently to this, the folding flaps do not "flop down" in the shrinking tunnel from their position against the packaging unit and that they are permanently fixed by the shrinking operation.

The respective folding operation may also be controlled in such a way that the individual folding operations wholly or partially overlap one another temporally. For example, the first and second folding operation, the first, the second, and the third folding operation, the second and third folding operation, the second, third and fourth folding operation etc., can temporally overlap. This means that it is conceivable and is within the scope of the invention to have two folding operations started at different times but to still provide for a mutual temporal overlap. This will usually be the adopted procedure, if only to tension the sheet material during this operation in the lateral region of the packaging unit, for during the respective folding operations, fold pockets in which subsequently folded folding flaps increasingly engage, will necessarily occur. In order to assist the forming of the fold pockets and at the same time to achieve a multilayered configuration of the sheet material in this region, the work is performed with the temporally overlapping folding operations as described.

Following the described folding operation, the sheet-material wrapper that is closed on all sides does indeed have at least two fold pockets that correspond with a multilayered sheet-material structure in their region. Because the fold pockets in question are predominantly observed in the lateral region and here at corners of the packaging unit, it is precisely these particularly stressed corners that receive a desired reinforcement and stiffening. A particularly stable combination of the group of articles is provided as a result. The packaging unit, which is provided with the inventively equipped sheet-material wrapper that is closed on all sides, does indeed exhibit a stability of form and position that has hitherto been unequaled. All of this is achieved within the framework of a continuous packaging operation. In the course of the folding operation, the individual folding steps are integrated into the usual production operation of a wrapped packaging unit of this type. As a result, the folding operation can run at high speed. This is due to the specially configured folding unit.

The folding unit typically exhibits at least one stationary and one moving folding element for the one or plurality of fold pockets. Two stationary and two moving folding elements are usually realized. The stationary folding elements can be configured as, on the one hand, a pressing rail and, on the other hand, as an angled guide. The respective moving folding element is, on the one hand, a rotating folding cam and, on the other hand, a folding driver that is moved together with the packaging unit. The speed of the folding driver will be matched to the speed of the packaging unit that is being conveyed on the transporting path in the running direction. Similar considerations apply to the rotational speed of the folding cam.

The described folding elements can be followed in the running direction by pressing elements. The pressing elements are, if necessary, equipped with fixing units for the folding flaps. Alternatively, or additionally, the folding elements can also exhibit the fixing units referred to above. The fixing units may take the form of heating elements, heated pressing plates etc., i.e. of objects or devices with the assistance of which the folding flaps are mutually fixed, temporarily or permanently. This is where the essential advantages are to be seen.

BRIEF DESCRIPTION OF THE DRAWINGS

The invention is explained more fully below by reference to drawings that collectively depict just one embodiment.

DETAILED DESCRIPTION

FIGS. 1 to 5 show an apparatus for the packaging of articles 1. In the depicted example, articles 1 are cans that, in this case, have been combined to form a group. In the depicted example, the cans exhibit a matrix-like six-by-four arrangement in which six cans 1 are arranged transversely to a running direction L, while four cans 1 are oriented along the running direction, in longitudinal direction, L. Appropriate sorting and orienting devices may be disposed upstream of the apparatus depicted in the figures in order to combine cans 1 to form the group of articles, to form a packaging unit 2 that is to be wrapped, and to position cans 1 correctly.

Figure 1:
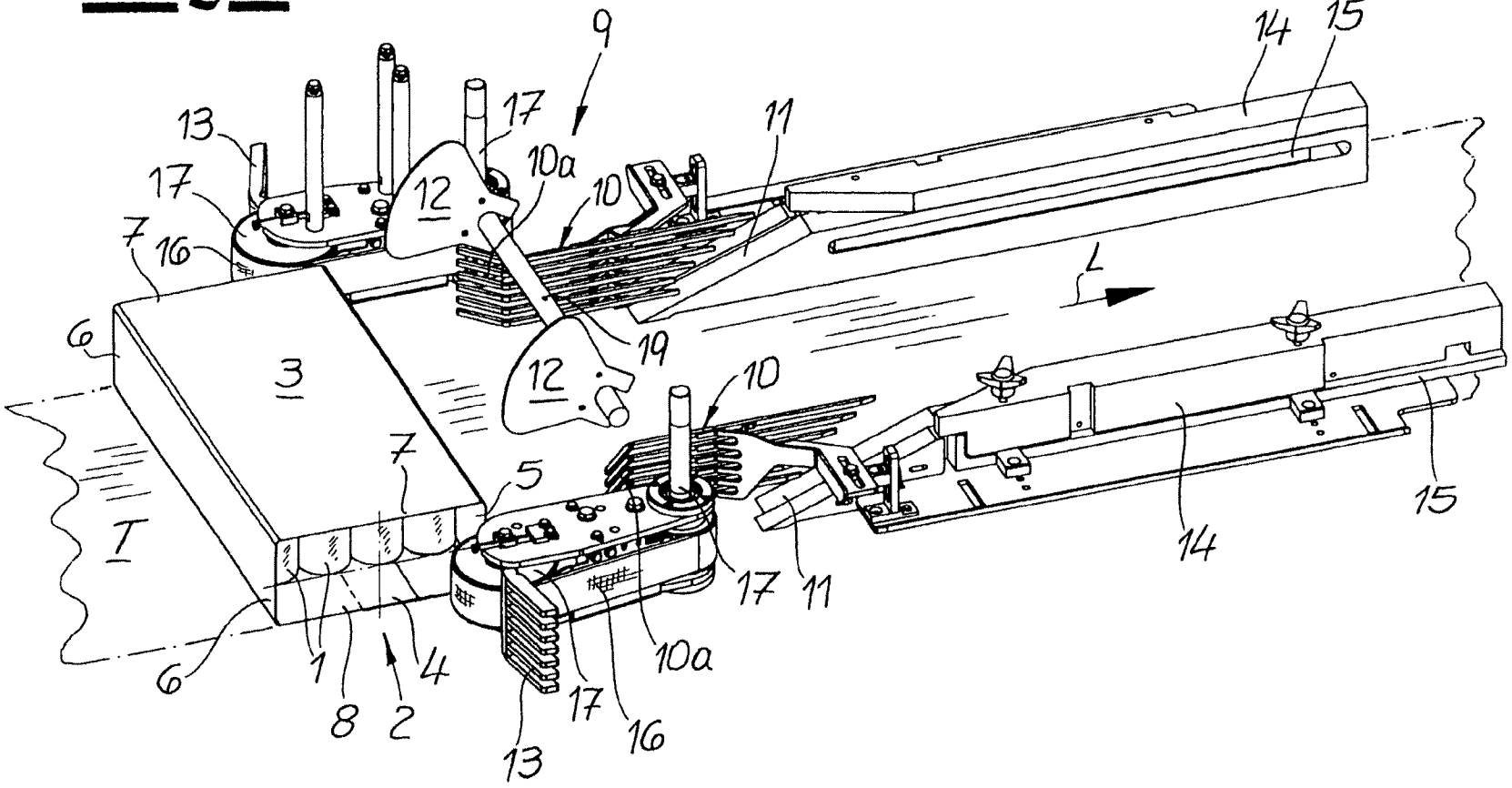
FIGS. 1 to 5 show steps of a method for the packaging of groups of articles combined to form packaging units in various phases, and the apparatus used for executing such a method.

This can be effected, for example, with the aid of stops and/or support bars that are not shown in detail. Nor do the figures show a storage drum for plastic sheet material 3 that has been wrapped around packaging unit 2 as shown in FIG. 1.

Plastic sheet material 3 may be produced from PE, PET, PP etc., as has already been described above. The wrapping of respective packaging unit 2 is effected in the running direction L during the transport of the group of articles or of cans 1 over or on a transporting path T. A sheet-material coil may be cut off and guided through a slit onto transporting path T for this purpose. Packaging unit 2 travels over the leading end of the sheet material coil.

As packaging unit 2 proceeds along transporting path T, a sheet material carrier bar moves from below, under the sheet-material coil, and describes, in the running direction L, a circular path or a generally circular path over the packaging unit 2. The sheet material carrier bar, together with the trailing end of the sheet material coil, subsequently descends into a further slit. As the packaging unit 2 that is wrapped is transported in this way, it travels over the slot and, as it does so, pulls the leading end of the sheet-material coil beneath itself. As a result, packaging unit 2 stands on the overlapping ends of the sheet material coil, and a sheet-material overlap 4 of both ends of the sheet-material coil is defined at the same time. Details of the described wrapping of packaging unit 2 with sheet material 3 are described in DE 42 07 725 A1, column 6, lines 30 to 54, the contents of which are herein incorporated by reference. Express reference is made to this and to the associated figures therein contained. In the case of the example, the width of the sheet-material overlap or sheet-material overhang 4 may be approximately 30 mm in the running direction L. This is, of course, only meant as an example.

As respective packaging unit 2 is wrapped in its running direction L on transporting path T with sheet material 3 and sheet-material overlap 4 is formed, folding flaps 5, 6, 7, 8, which each project beyond packaging unit 2 along the transverse peripheries, are defined at the same time.

The two folding flaps 5, 6 lie opposite each other and form an associated first folding-flap pair 5, 6. As the packaging unit 2, wrapped with the aid of sheet material 3, enters a folding unit 9, first folding-flap pair 5, 6, or associated folding flaps 5, 6, which lie opposite one another, are positioned by a predominantly horizontal folding operation against the packaging unit 2. The horizontal folding operation comes about because the folding flaps 5, 6, which lie opposite one another, are folded along an only suggested horizontal folding plane and positioned against the packaging unit 2.

Two further folding flaps 7, 8, which also lie opposite one, another are realized in addition to the two folding flaps 5, 6 or first folding-flap pair. The two further folding flaps 7, 8 define a second folding-flap pair 7, 8. The two folding flaps 7, 8 of the second folding-flap pair, which lie opposite one another, are positioned against the packaging unit 2 by a predominantly vertical folding operation. This is suggested by a vertical line that marks the vertical folding plane associated with this vertical folding operation.

Folding unit 9, which is for positioning folding flaps 5, 6, 7, 8 against packaging unit 2, is composed of stationary folding elements 10, 11 and of moving folding elements 12, 13 that are moved by the packaging unit 2. The moving folding elements 12, 13 are displaced predominantly synchronously together with packaging unit 2, which is moved in running direction L along transporting path T.

It can be seen in the figure how the two stationary folding elements 10, 11 and the two moving folding elements 12, 13 are realized. The stationary folding elements 10, 11 include a pressing rail 10 and an angled guide 11. The moving folding elements 12, 13 include a rotating folding cam 12 and a folding driver 13, which is moved with the packaging unit 2.

When seen in the running direction L, pressing elements 14 also follow folding unit 9 and folding elements 10, 11, 12, 13, which are realized inside folding unit 9. In fact, two elongated pressing elements 14 in the running direction L are realized. The pressing elements 14 are associated in pairs with the transverse peripheries of the packaging unit 2 or with its lateral regions. The folding elements 10, 11, 12, 13 are also provided in pairs and are each associated with the related transverse periphery or lateral region of the packaging unit 2.

Fixing units 15 are integrated in folding elements 14. In the embodiment shown, the fixing units 15 are charging electrodes that ensure that the folding flaps 5, 6, 7, 8 positioned against packaging unit 2 inside the folding unit 9 receive a temporary fixing. A permanent fixing may be provided by a shrink tunnel or a shrinking unit into which the packaging unit 2, which will have been wrapped in the sheet material 3, enters subsequent to the positioning of folding flaps 5, 6, 7, 8 and following the pressing elements 14. The shrink tunnel/shrinking unit in question is not depicted.

In the illustrated embodiment, the pressing elements 14 are designed to be interchangeable and can be adapted, for example in their length, to the dimensions of the packaging unit 2 that is to be wrapped in the sheet material 3. The pressing elements 14 and their associated fixing units 15 together form a pressing-and-charging unit 14, 15 that, when seen in the running direction L, immediately follows the folding unit 9.

It can be seen that the pressing rail 10 and the folding driver 13 are comb-like in configuration. As a result, the folding driver 13 can partly engage the pressing rail 10 through inter-digitation of the comb teeth, as is made clear by the functional representation in FIG. 4. In the illustrated embodiment, the folding driver 13 is connected to a belt 16 circulating around two rollers 17, at least one of which is driven and provides a way to adjust the speed of the speed of the folding driver 13.

The speed of transporting path T in the running direction L of the folding driver 13 and the speed of the packaging unit 2 wrapped with sheet material 3 are adapted to one another or are synchronized with one another, as will be described in more detail. It goes without saying here that both speeds can be controlled or regulated, and that this also applies to their associated speed ratio, so as to guarantee the synchronous movement of the folding driver 13 with the packaging unit 2 as it runs in and through the folding unit 9 and which is wrapped with sheet material 3. The driving of the packaging unit 2 may be served by a not expressly depicted conveyor belt, but may also be provided, for example, by rails or comparable moving elements lying on the trailing edge of the packaging unit 2. The packaging unit 2 is propelled along transporting path T predominantly horizontally and first enters the folding unit 9. Folding flaps 5, 6, 7, 8 are positioned against packaging unit 2 inside the folding unit 9. The folding flaps 5, 6, 7, 8 are mutually fixed inside and/or subsequent to the folding unit 9.

Figure 5:
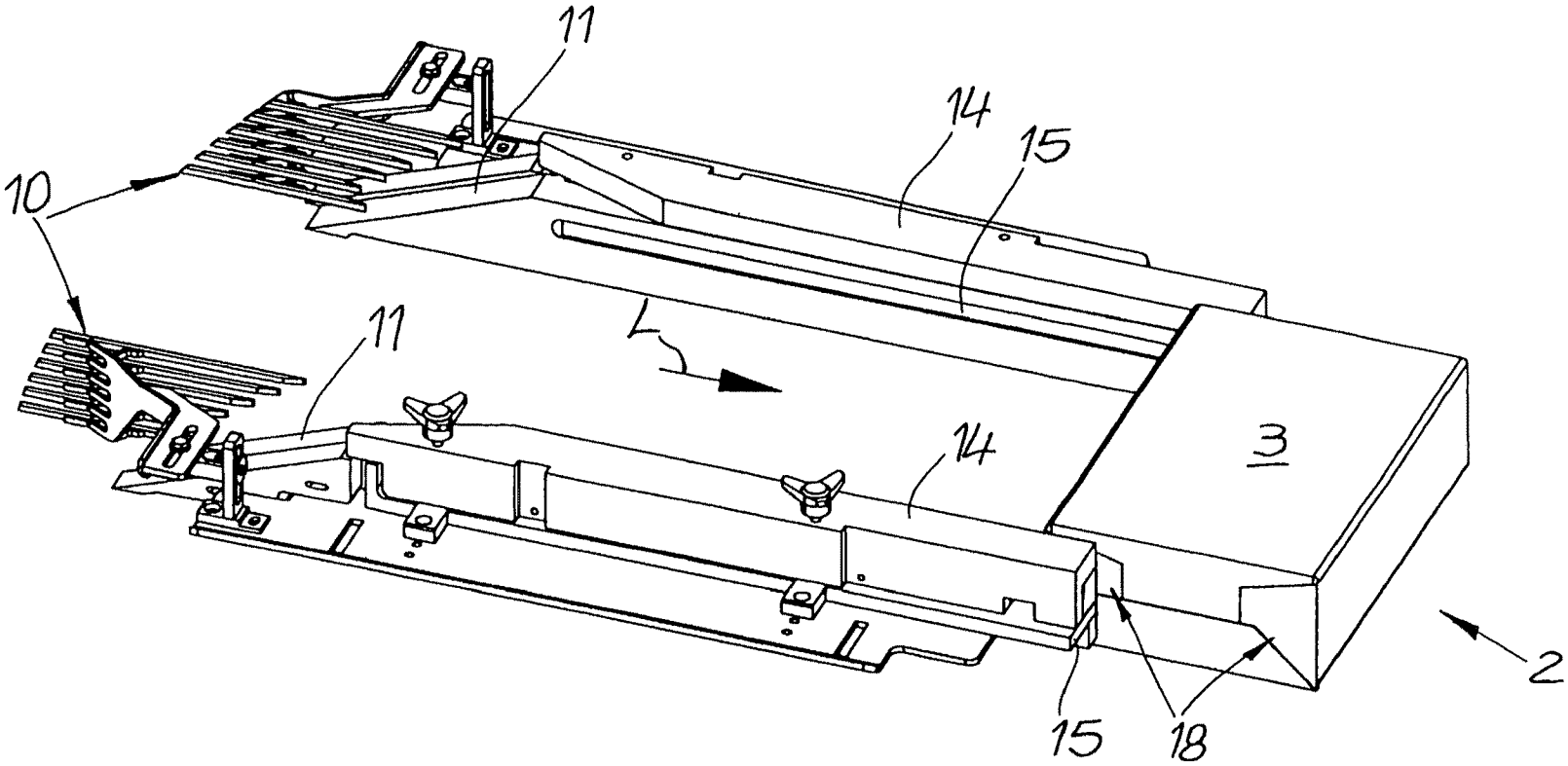

Within the scope of the embodiment there is effected, subsequent to the folding unit 9, a temporary fixing of the folding flaps 5, 6, 7, 8 to one another. This is ensured by charging the electrodes 15 in the pressing-and-charging unit 14, 15 that comes immediately after the folding unit 9. In any event, a fully enclosed sheet-material wrapper as depicted in FIG. 5 emerges from folding unit 9 or the pressing-and-charging unit 14, 15 respectively.

This fully enclosed sheet-material wrapper has two fold pockets 18 in the lateral region of the packaging unit 2 or on its respective transverse periphery. In the region of fold pockets 18, the sheet material 3 exhibits a two-layer or even a three-layer structure such that the fold pockets 18 are characterized by particular stability and/or such that the corner regions of the packaging unit 2 exhibit increased stability.

The procedure when packaging respective packaging unit 2 is explained hereinbelow by reference to FIGS. 1 to 5, which together represent the individual packaging steps. FIG. 1 shows the situation in which packaging unit 2, equipped with the aid of sheet material 3, enters the stationary folding unit 9. The folding flaps 5, 6, 7, 8 are positioned against the packaging unit 2 as it traverses the folding unit 9. Of the first folding-flap pair 5, 6, folding flap 5, which leads in the running direction L, is positioned first. This happens automatically as the packaging unit 2 runs up against the pressing rail 10 as it is transported along the transporting path T in the running direction L. Because the pressing rail 10 is equipped with angled entry sections 10*a*, the described folding operation of the respectively leading folding flap 5 of the first folding flap pair 5, 6 takes place gradually.

Immediately subsequent to this, the upper folding flap 7 of the second folding-flap pair 7, 8 is positioned against the packaging unit 2. The two folding operations of the leading folding flap 5 on the one hand and the upper folding flap 7 on the other hand take place with a temporal overlap, quasi simultaneously. This applies generally. This means that the folding operations for the individual flaps 5, 6, 7, 8 can be optionally performed with a temporal overlap in order to produce fold pockets 18 or to tension or stretch the sheet material 3 during the folding operation.

The rotating folding cam 12 is responsible for the folding operation of the upper folding flap 7. Two folding cams 12, which are connected to each other for co-rotation by a common shaft 19 and moved together by a motor which drives the common shaft 19, are in fact realized. The motor is triggered such that the rotation of the folding cams 12 about their common shaft 19 is synchronized with the transport movement of the packaging unit 2 in the running direction L.

Figure 2:
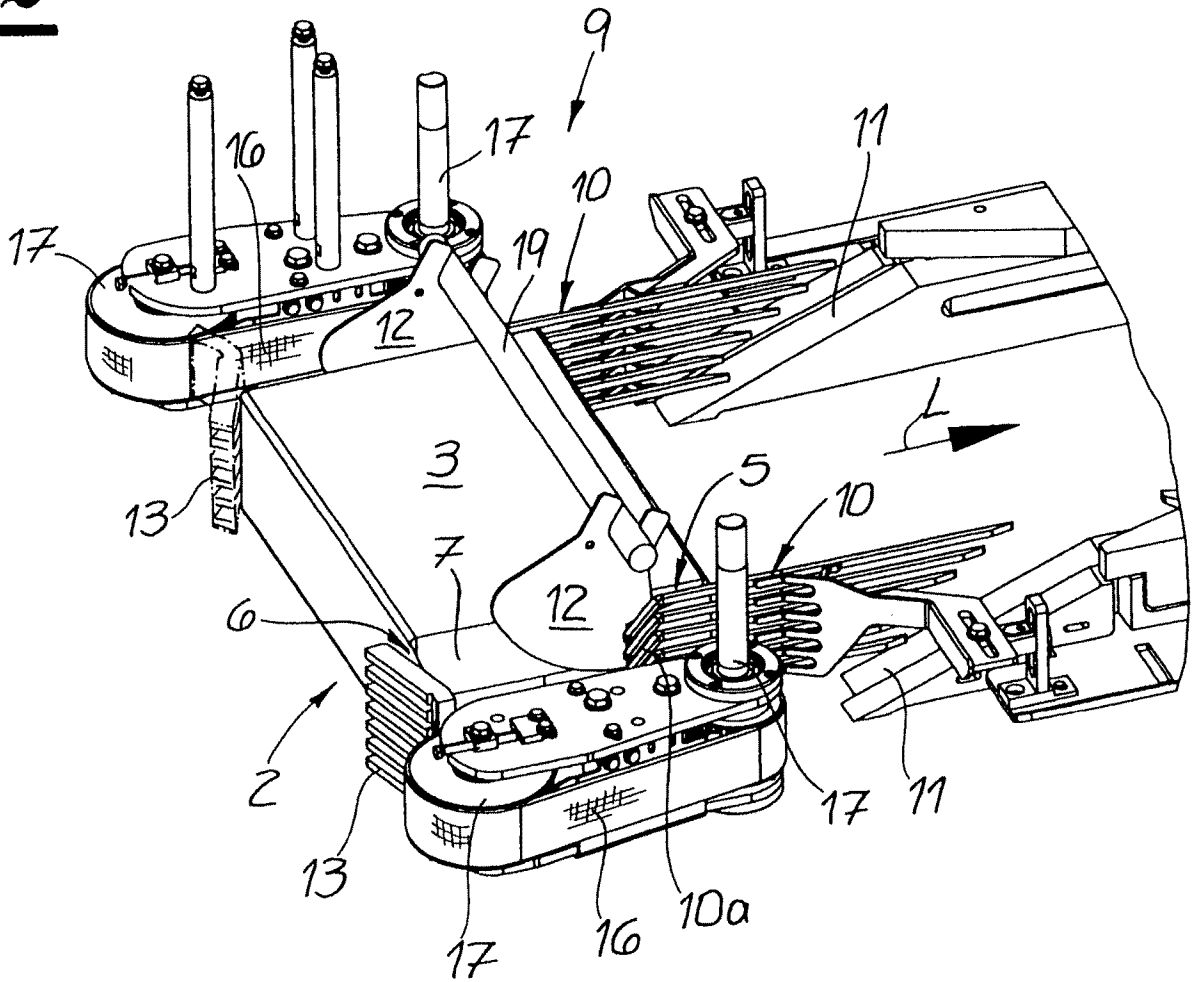

The corresponding folding operation is visible in FIG. 2. This depiction clearly shows how the stationary pressing rail 10 has increasingly positioned the leading folding flap 5 of the first folding-flap pair 5, 6 against the packaging unit 2. At the same time, the folding cam 12 ensures that the upper folding flap 7 is positioned fully against the packaging unit 2 first, so that the folding operation for the leading folding flap 5 can then be completed and the latter can be positioned from the outside up against the upper folding flap 7. During this operation, the folding cam 12 moves through between the packaging unit 2 and the stationary pressing rail 10.

Figure 3:
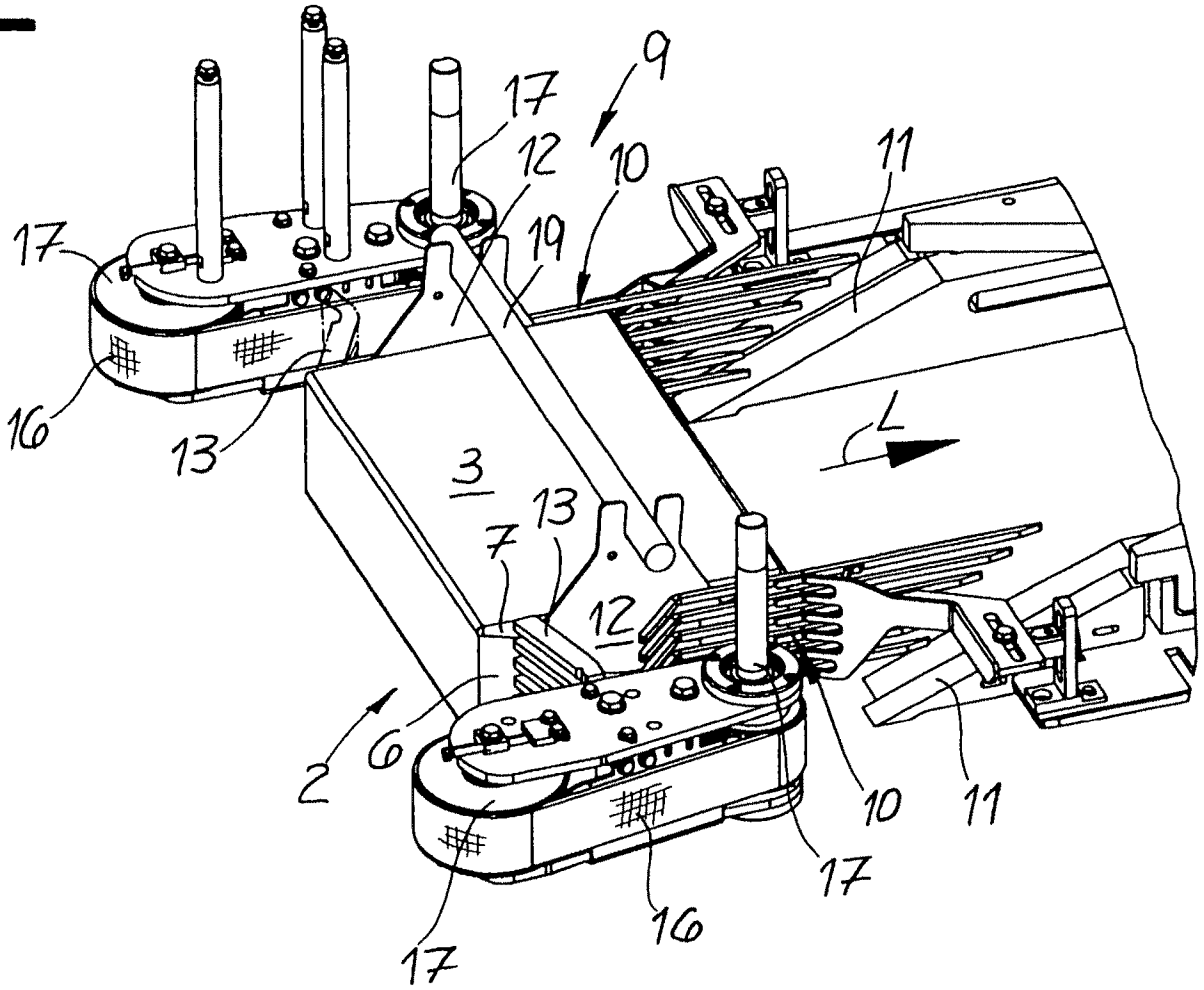

With reference to FIG. 3, the folding flap 6 of the first folding-flap pair 5, 6, and which is trailing in the running direction L, is now positioned against the packaging unit 2. Because the upper folding flap 7 is already positioned against packaging unit 2, this means that the trailing folding flap 6 is guided to upper folding flap 7 in contact against packaging unit 2. This is ensured by the folding driver 13.

In the transition from FIG. 1 to FIG. 2, and finally to FIG. 3, the folding driver 13 has actually run up against the folding flap 6. As it continues moving, the folding driver 13 ensures that the trailing folding flap 6 is positioned against the packaging unit 2. During this operation, the folding cam 12 is located unchanged in its position against the upper folding flap 7 and is kept in its position pressed against the packaging unit 2.

The shaft 19, to which the two folding cams 12 are connected, is stationary. One or both folding cams 12 move synchronously with the packaging unit 2 conveyed on the transporting path T in the running direction L. During this operation, the respective folding cam 12 executes an approximately 180° rotation, as is made clear by a comparison of FIGS. 1 and 4. The design here is selected so that the folding cam 12 stands almost vertically, as shown in FIG. 3.

Because the folding cam 12 is configured like a segment of a circle, the vertical position of a respective cam 12, as shown in FIG. 3, corresponds to the folding cam 12 maximizes an area of an overlap with the packaging unit 2. This is intentional and in this context particularly advantageous because, through this maximum overlap in area, the upper folding flap 7, which is designed to be particularly large in area, is pressed fully up against the packaging unit 2, and in fact almost until, as well as leading folding flap 5, trailing folding flap 6 of the first folding-flap pair 5, 6 additionally provides for and also can provide for the fixing of the upper folding flap 7 to the packaging unit 2. This is the case when the folding driver 13 has fully positioned the trailing folding flap 6 against the packaging unit 2 subsequent to the transition from FIG. 3 to FIG. 4.

Figure 4:
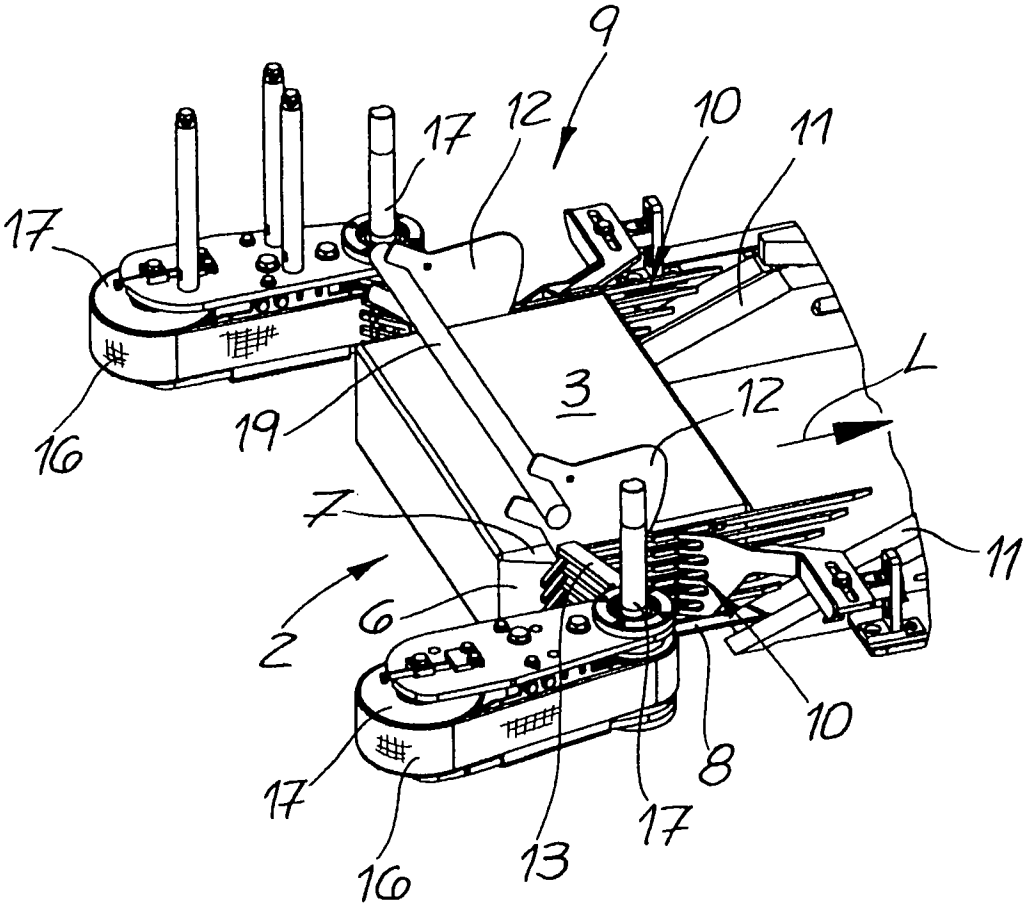

It is in fact possible to see, from FIG. 4, that in the functional position according to FIG. 4, the folding driver 13, which is moved by the belt 16, overlaps comb-like with the equally comb-like pressing rail 10 or the latter's entry section 10*a*.

The folding driver 13 thereby ensures that the trailing folding flap 6 is positioned fully against the packaging unit 2 after passing the entry section 10*a*. The folding cam 12 can now increasingly leave the upper folding flap 7 because, in addition to the leading folding flap 5, upper folding flap 7 is held by the trailing folding flap 6 and fixed in contact against the packaging unit 2.

In the depiction according to FIG. 4, the leading folding flap 5, the upper folding flap 7 and the trailing folding flap 6 are held in contact against the packaging unit 2 by the pressing rail 10. As the packaging unit 2 proceeds along its path, the lower folding flap 8 now increasingly runs up against the stationary angled guide 11. During this operation, the lower folding flap 8 is raised and gradually positioned against the packaging unit 2. Having passed the folding unit 9 subsequent to the depiction according to FIG. 4, all folding flaps 5, 6, 7, 8 are located in position against the packaging unit 2, namely while the two fold pockets 18 are being defined at the same time, as shown in FIG. 5.

After the folding unit 9, the packaging unit 2, now equipped in such a way with the totally enclosed sheet-material wrapper, traverses the already described pressing-and-charging unit 15 in which the pressing elements 14 ensure that the folding flaps 5, 6, 7, 8 are held unchanged in position against the packaging unit 2. At the same time, the fixing units or charging electrodes 15 ensure that the folding flaps 5, 6, 7, 8 receive a temporary mutual fixing achieved by an electrostatic charge. For this purpose the fixing unit or charging electrode 15 is arranged in the region of an overlap of the respective folding flaps 5, 6, 7, 8 such that all the folding flaps 5, 6, 7, 8 can be engaged with the aid of the charging electrode 15 and electrostatically charged as desired.

As a result, the folding flaps 5, 6, 7, 8 after leaving the pressing-and-charging unit 14, 15, remain in position against the packaging unit 2, as shown at the right of FIG. 5. Subsequent to this, the packaging unit 2, equipped in such a way with the totally enclosed sheet-material wrapper, can enter the previously mentioned shrink tunnel in which the sheet material 3 is heated and then shrunk. Because the sheet material 3 is totally sealed, a particularly stable packaging unit 2 is available at the exit end of the shrink tunnel. Because it has been closed completely on all sides with the aid of the sheet material 3, the packaging unit 2 not only holds articles 1 therein stored in their relative mutual orientation but also protects them from, for example, dirt.

Having described the invention, and a preferred embodiment thereof, what is claimed as new and secured by Letters Patent is:

1. A method comprising using sheet material to envelop containers that have been arranged into a packaging unit, wherein using said sheet material to envelop said containers comprises conveying said packaging unit along a running direction thereof on a horizontal transport path with said sheet material, said horizontal transport path leading to a folding machine, said sheet material having been formed into a sheet-material overlap defined by overlapping ends of said sheet material upon which said containers stand upright with bases thereof in contact with said overlapping ends of said sheet material, and folding flaps that each project beyond said packaging unit along transverse peripheries thereof, receiving said packaging unit at said folding machine, wherein, by the time said folding machine receives said packaging unit, said packaging unit has already been wrapped, wherein, by the time said folding machine receives said packaging unit, said folding flaps are already projecting from said transverse peripheries, then, after said folding machine has received said packaging unit, causing said folding machine to position said folding flaps against said packaging unit as said packaging unit passes through a folding unit, and after having positioned said flaps against said packaging unit, and while said flaps are still positioned against said packaging unit, causing said folding flaps, which are positioned against said packaging unit but not yet fixed to each other, to become fixed to each other as said packaging unit passes through said folding machine, thereby forming a sheet-material wrapper that is closed on all sides, wherein forming folding flaps comprises forming first and second folding-flap pairs, each of which comprises a pair of opposed folding flaps, and positioning said folding flaps one after the other against said packaging unit, and wherein positioning said folding flaps against said packaging unit comprises using pressing rails with angled folding sections to position a leading folding flap of said first folding-flap pair, using a rotating cam to position an upper folding flap of said second folding-flap pair against said packaging unit, then, after having positioned said leading folding flap of said first folding-flap pair and said upper folding flap of said second folding-flap pair against said packaging unit, using a rotating comb for positioning a trailing folding flap of said first folding-flap pair against said packaging unit, said rotating comb interdigitating with said pressing rails, and after having positioned said trailing folding flap of said first folding-flap pair against said packaging unit, positioning a lower folding flap of said second folding-flap pair against said packaging unit.

2. The method of claim 1, further comprising positioning folding flaps of said first folding-flap pair by a predominantly horizontal movement during a folding operation and positioning folding flaps of said second folding-flap pair against said packaging unit by a predominantly vertical movement during a folding operation.

3. The method of claim 1, further comprising folding said folding flaps, wherein folding said folding flaps comprises using a stationary folding element.

4. The method of claim 1, further comprising folding said folding flaps, wherein folding said folding flaps comprises using four moving folding elements.

5. The method of claim 4, further comprising moving said moving folding elements synchronously together with said packaging unit.

6. The method of claim1, further comprising, using a first stationary folding element, positioning said leading folding flap of said first folding-flap pair against said packaging unit, and using a second stationary folding element, positioning said lower folding flap of said second folding-flap pair against said packaging unit.

7. The method of claim 6, further comprising, using a first moving folding element, positioning said upper-folding flap of said second folding-flap pair against said packaging unit, and, using a second moving folding element, positioning said trailing folding flap of said first folding-flap pair against said packaging unit.

8. The method of claim 1, wherein fixing said folding flaps to each other comprises fixing said folding flaps using folding elements.

9. The method of claim 1, wherein fixing said folding flaps to each other comprises fixing said folding flaps using pressing elements.

* * * * *